United States Patent [19]

Greenberg et al.

[11] 4,193,077

[45] Mar. 11, 1980

[54] DIRECTIONAL ANTENNA SYSTEM WITH END LOADED CROSSED DIPOLES

[75] Inventors: Harry Greenberg, Kerhonkson; Richard Auerbach, Southtown, both of N.Y.

[73] Assignee: Avnet, Inc., Ellenville, N.Y.

[21] Appl. No.: 840,833

[22] Filed: Oct. 11, 1977

[51] Int. Cl.[2] ..... H01Q 21/26

[52] U.S. Cl. ..... 343/747; 343/797; 343/876

[58] Field of Search ..... 343/747, 797, 807, 876, 343/702, 802, 854

[56] References Cited

U.S. PATENT DOCUMENTS

| | | | |
|---|---|---|---|
| 2,552,816 | 5/1951 | Root | 343/802 |
| 2,622,197 | 12/1952 | Cruser | 343/802 |
| 2,838,755 | 6/1958 | Albright et al. | 343/876 |
| 2,885,673 | 5/1959 | Bittner et al. | 343/876 |
| 2,942,259 | 6/1960 | Green | 343/802 |
| 3,248,736 | 4/1966 | Bohar | 343/797 |
| 3,277,491 | 10/1966 | Liu | 343/802 |
| 3,518,695 | 6/1970 | Schroeder | 343/854 |
| 3,604,007 | 9/1971 | Solby | 343/797 |
| 3,605,102 | 9/1971 | Frye | 343/797 |

*Primary Examiner*—Eli Lieberman
*Attorney, Agent, or Firm*—Darby & Darby

[57] ABSTRACT

An electrically directable antenna system is provided which is tunable to individual stations in the FM band. The antenna system includes a pair of crossed, forshortened dipole components which are arranged to be mutually perpendicular. Each of the dipole components includes a pair of longitudinally aligned arms which are flared at their outer ends so as to be shaped generally like an arrow. At their inner ends, these arms are connected to a narrow bandwidth tuner network which is designed to resonate the dipole components at a frequency corresponding to a selected station and to impedance match each of the dipole components to the input of the FM receiver. The tuner network includes a bandwidth control, which is operable to produce a predetermined impedance mismatch between the dipole components and the receiver input so that, without changing the frequency to which the antenna system is tuned, the overall antenna system gain can be made substantially constant over the entire FM band. The signals from the four dipole arms, as coupled through the tuner network, are selectively combined in a direction selector switch so that the signal provided from the switch to the receiver input is either: one of the dipole component signals, the sum of the two dipole component signals, or the difference between the two dipole component signals. The particular signal applied to the receiver determines the directionality of the antenna system.

9 Claims, 8 Drawing Figures

DIRECTIONAL ANTENNA SYSTEM WITH END LOADED CROSSED DIPOLES

This invention relates generally to high frequency antennas useful in television and frequency modulation receivers and, more particularly, concerns an antenna system which may be adjusted to receive a signal from any direction without physically Various types of high frequency antennas are available in the prior art for use with television and frequency modulation (FM) receivers. Good quality reception of program material almost invariably requires an antenna that can be oriented to correspond with the direction of strongest signal. In one prior art antenna, orientation is achieved electrically, without physically moving the antenna, by utilizing a pair of crossed dipole antenna components which are disposed to be effective in mutually perpendicular directions. An adjustable element selectively combines the signals from the two crossed dipole antenna components to control the direction of reception of the composite antenna, thereby effectively orienting the antenna to the direction of the received radio frequency signal.

Although electrically directable antennas have been available for use in high frequency signal receivers, these antennas have not possessed certain characteristics desirable in such applications. For example, in congested areas such antenna systems are likely to be used by apartment house dwellers within their apartments and must, therefore, be compact. A normal half-wave dipole antenna for a frequency modulation receiver is approximately five feet long and would not yield a compact antenna system. In addition, it would be desirable to provide an antenna with a relatively narrow bandwidth that is tunable over the entire reception band. This would not only filter out unwanted adjacent stations which are close in frequency to a desired station, but would increase the overall gain of the antenna itself. Unfortunately, providing a narrow bandwidth, tunable antenna unnecessarily complicates receiver tuning, since it is then necessary to align the receiver and antenna in frequency, and small misalignments can result in substantially deteriorated reception. If the antenna system is additionally made to be directable, tuning for satisfactory reception becomes a difficult and time consuming task for the typical operator who has no special tuning equipment available.

Broadly, it is an object of the present invention to overcome one or more of the disadvantages in prior art high frequency antenna systems. Specifically, it is within the contemplation of the present invention to provide a high frequency antenna system, useful with television and frequency modulation receivers, which can be oriented to the direction of maximum signal strength without physically moving the antenna.

It is another object of the present invention to provide an antenna system of the type described which can provide gain comparable to a normal half-wave dipole antenna, yet is substantially more compact.

It is yet another object of this invention to provide an antenna system of the type described which can provide gain over a relatively narrow bandwidth, is tunable over the entire frequency range of stations to be received, yet does not complicate receiver tuning.

It is a further object of this invention to provide an antenna of the type described which is simple and rugged in construction, reliable in operation under repeated use, yet relatively inexpensive in cost.

In accordance with an illustrative embodiment demonstrating objects and features of the present invention, there is provided an electrically directable antenna system for frequency modulation receivers which is tunable to individual stations in the FM band. The antenna system includes a pair of crossed, forshortened dipole components which are arranged to be mutually perpendicular. Each of the dipole components includes a pair of longitudinally aligned arms which are flared at their outer ends so as to be shaped generally like an arrow. At their inner ends, these arms are connected to a narrow bandwith, tuner network which is designed to resonate the dipole components at a frequency corresponding to a selected station and to impedance match each of the dipole components to the input of the FM receiver. The tuner network includes a bandwidth control, which is operable to produce a predetermined impedance mismatch between the dipole components and the receiver input so that, without changing the frequency to which the antenna system is tuned, the overall antenna system gain can be made substantially constant over the entire FM band. The signals from the four dipole arms, as coupled through the tuner network, are selectively combined in the direction selector switch so that the signal provided from the switch to the receiver input is either: one of the dipole component signals, the sum of the two dipole component signals, or the difference between the two dipole component signals. The particular signal applied to the receiver determines the directionality of the antenna system.

In operation, optimum tuning of the antenna system and the receiver can be achieved in two distinct but simple steps. Initially, the tuner network is adjusted to tune the antenna system to the center of the FM band and its bandwidth control is adjusted to the broadband mode. This permits all FM stations to be received with substantially the same antenna, so that the receiver may be tuned and the direction selector switch adjusted for optimum reception of the desired station. Once this is done, the tuner network may be switched to its narrow band mode and adjusted for the best overall reception. With the antenna system and receiver so adjusted, maximum selectivity and antenna gain are achieved.

The foregoing brief description, as well as further ojbects, features and advantages of the present invention will be more completely understood by referring to the following detailed description of the presently preferred, but nonetheless illustrative, embodiments in accordance with the present invention, with reference being had to the accompanying drawing wherein.

Figure 1:
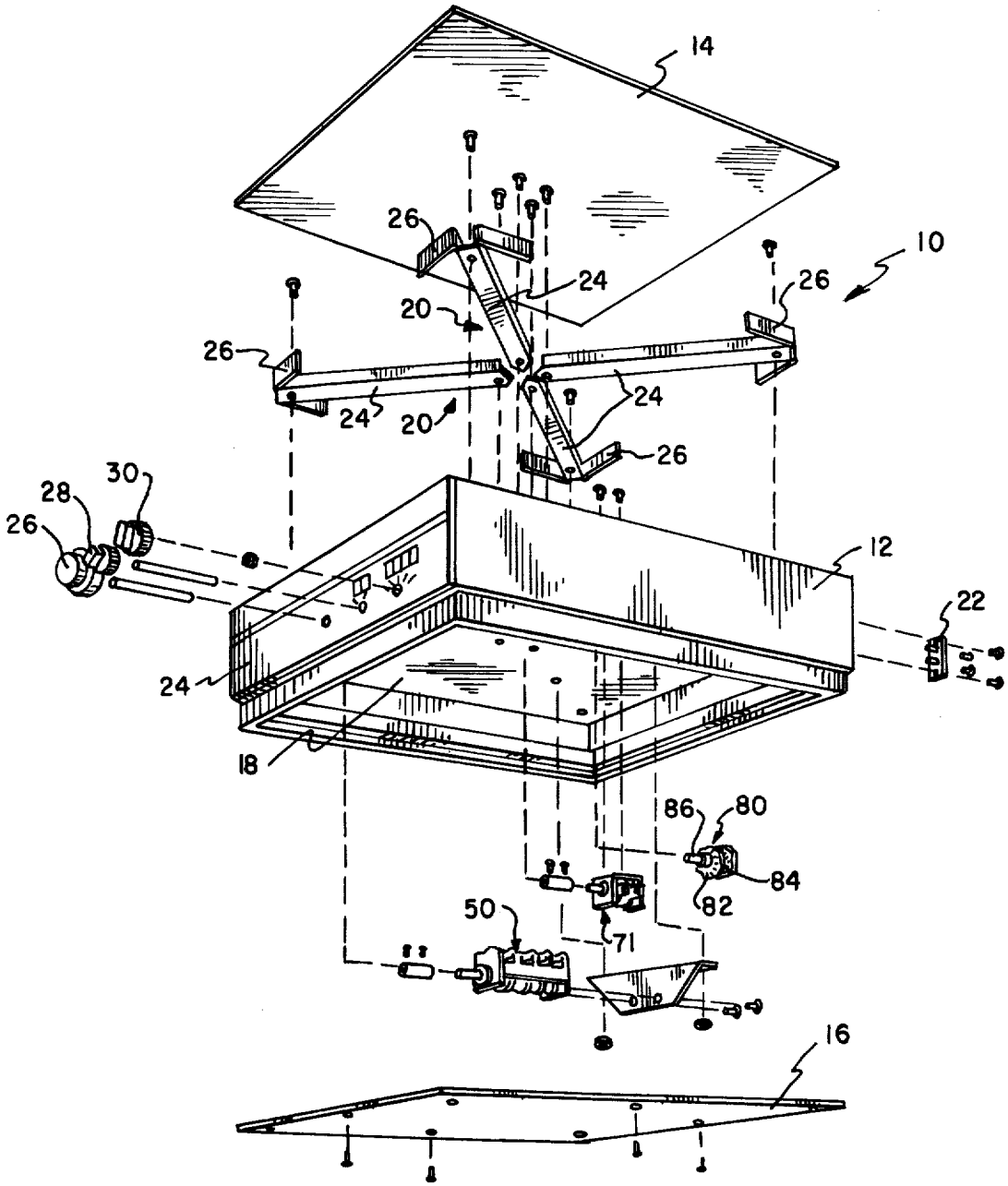
FIG. 1 is an exploded perspective view of an antenna system in accordance with the present invention which is useful with a frequency modulation receiver, the elements of the system being exploded to show the detailed construction and arrangement thereof.

Referring now to the details of the drawing, FIG. 1 shows an antenna system 10 incorporating objects and features of the present invention to provide reception for an FM receiver. The antenna system 10 includes a cabinet 12 which serves as a housing for the components of this system and is made, for example, of decorative wood. The top and bottom of cabinet 12 are enclosed by insulative covers 14 and 16, respectively, and an insulative circuit board 18 is mounted inside cabinet 12 so as to be parallel to covers 14 and 16. A pair of crossed dipole components 20 are mounted on top of circuit board 18 so as to be mutually perpendicular, and the electrical circuit elements which control these dipole components are mounted on the undersurface of circuit board 18.

A terminal strip 22, mounted on the rear of cabinet 12, is provided for connection of a lead-in cable from antenna system 10 to an FM receiver (not shown), and the front face of cabinet 12 has a control pannel 24 which includes the control knobs 26, 28 and 30. Knob 26 operates a control element which is continuously ariable and serves to tune the antenna system 10 to a particular station in the FM band. Knob 28 operatees a control element which has two positions. In one position the bandwidth of the antenna system 10 is extremely narrow, so that essentially only the station tuned in is received by the antenna system. In the other position, the bandwidth of the antenna system is wide, so that a substantially the same gain is provided by the antenna system for all stations. Knob 30 operates a four position direction selector switch, which adjusts the antenna system 10 for bi-directional reception at points of the compass which are spaced by 45°. For example, if the dipole components 20 are arranged so that one is directed north and south while the other is directed east and west, switching knob 30 to any of its four positions would provide reception of signals from the north and south, the east and west, the northeast and southwest, or the northwest and southeast.

The dipole components 20 comprising the antenna portion of the system 10, each include a pair of longitudinally aligned arms 24. At its outermost end, each arm 24 is formed with a flared front 26, so that the arm has the general appearance of an arrow. As will be explained in more detail below, this flared front construction provides capacitive top loading between the arms 24, thereby substantially improving the matching characteristics and efficiency of the antenna. In the illustrative embodiments, the portions of the arm 24 forming the flared front 26 lie in perpendicular planes so that the arms 24 are conveniently mounted diagonally within cabinet 12, with each of the flared fronts 26 engaging a corner of the cabinet. This mounting of the arms 24 conserves space.

Figure 2:
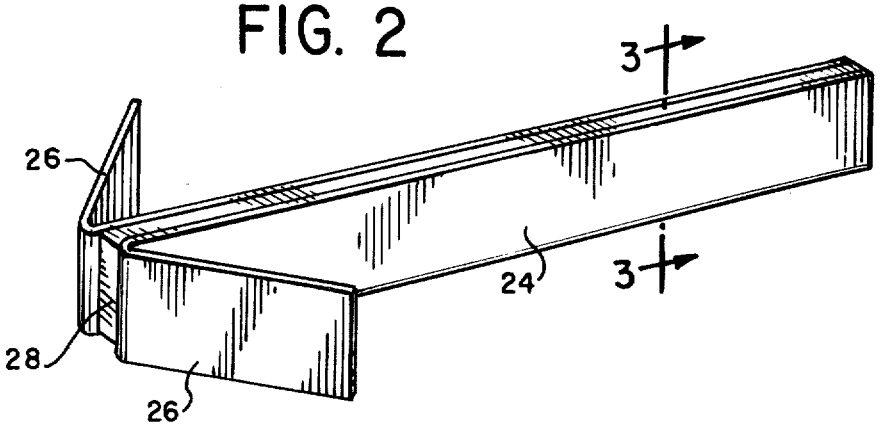
FIG. 2 is a perspective view, on an enlarged scale, of one of the dipole component arms.
Figure 3:
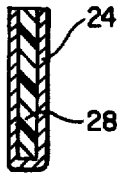
FIG. 3 is a sectional view, on an enlarged scale, taken along line 3—3 in FIG. 2 to illustrate further construction details of the dipole component arm.
Figure 4:
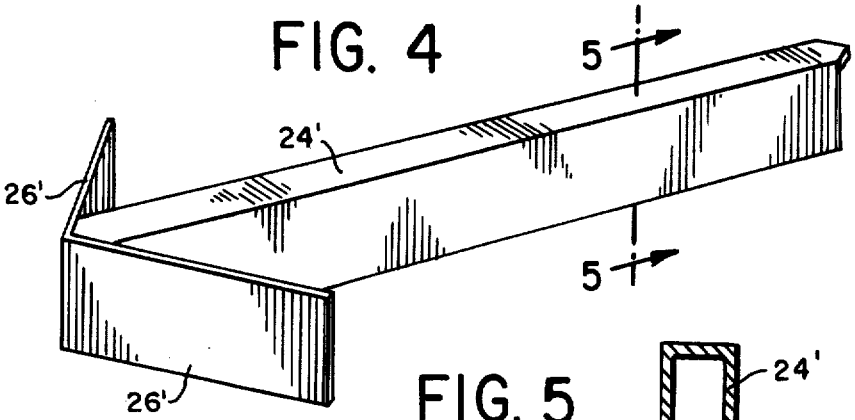
FIG. 4 is a perspective view showing in alternate construction for a dipole component arm.
Figure 5:
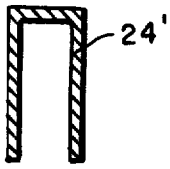
FIG. 5 is a sectional view, on an enlarged scale, taken along line 5—5 in FIG. 4 to illustrate further details of the dipole component arm.
Figure 6:
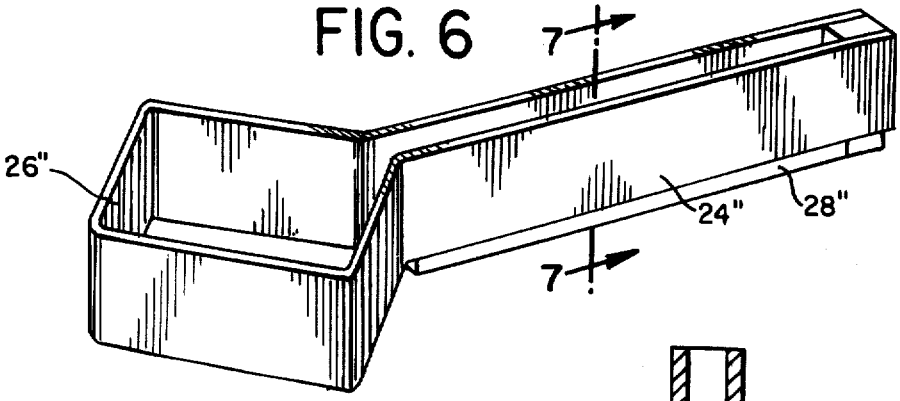
FIG. 6 is a perspective view showing a second alternative dipole arm construction.
Figure 7:
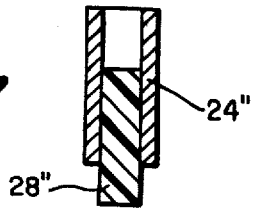
FIG. 7 is a sectional view, on an enlarged scale, taken along line 7—7 in FIG. 6 to illustrate further details of the dipole component arm construction.

In the construction of arm 24 shown in FIGS. 1, 2 and 3, the arm is conveniently made of a highly conductive sheet metal which is formed into an elongated channel with a generally U-shaped cross section. At the front of each arm, a length of the bottom of the U-shape is removed and the remaining parallel sides are bent back to form the flared front 26. Should the sheet metal be very thin, it may be desirable to incorporate an insulative core element 28 to lend support and rigidity to the arm. The alternate construction 24' of arm 24 illustrated in FIGS. 4 and 5 preferably utilizes a conventional extruded aluminum member for the main body of the arm 24'. The flared front piece 26' can be made from aluminum sheet stock and can be fastened to the extruded member by conventional means. A second alternative form 24" of the arm 24 is shown in FIGS. 6 and 7, in which a single continuous piece of sheet metal material forms the entire arm. The insulative member 28" lends support to the arm structure and helps retain the flared shape of front portion 26". Although specific arm constructions, which are presently preferred, have been shown for illustrative purposes, it will be appreciated by those skilled in the art that various other arm constructions with flared fronts are possible without departing from the general principal of the invention. The term "flared front", as used herein, is therefore not intended to be limited to the specific embodiments of the arms which have been disclosed, but is intended to encompass all equivalent constructions.

As previously mentioned, the flared fronts on the antenna arms lend capacitive top loading to the antenna. This increases the radiation resistance of the antenna, improves its efficiency and minimizes losses. As a result, it is easier to impedance match the antenna to a receiver, and the gain of a full size antenna is closely approximated with substantially shorter dipole components. In the preferred embodiments, the arms comprising the dipole components are approximately 8 inches in length. Thus, each dipole component is less than 20 inches long and the composite antenna closely approximates the gain of of a half-wave dipole antenna which, in the present application, would be approximately 60 inches long. It will therefore be appreciated that the use of forshortened antenna arms with flared fronts provides a substantially more compact antenna system. The foreshortened arms also have a much narrower reception bandwidth than a half-wave dipole antenna and therefore provide increased selectivity between adjacent stations.

Figure 8:
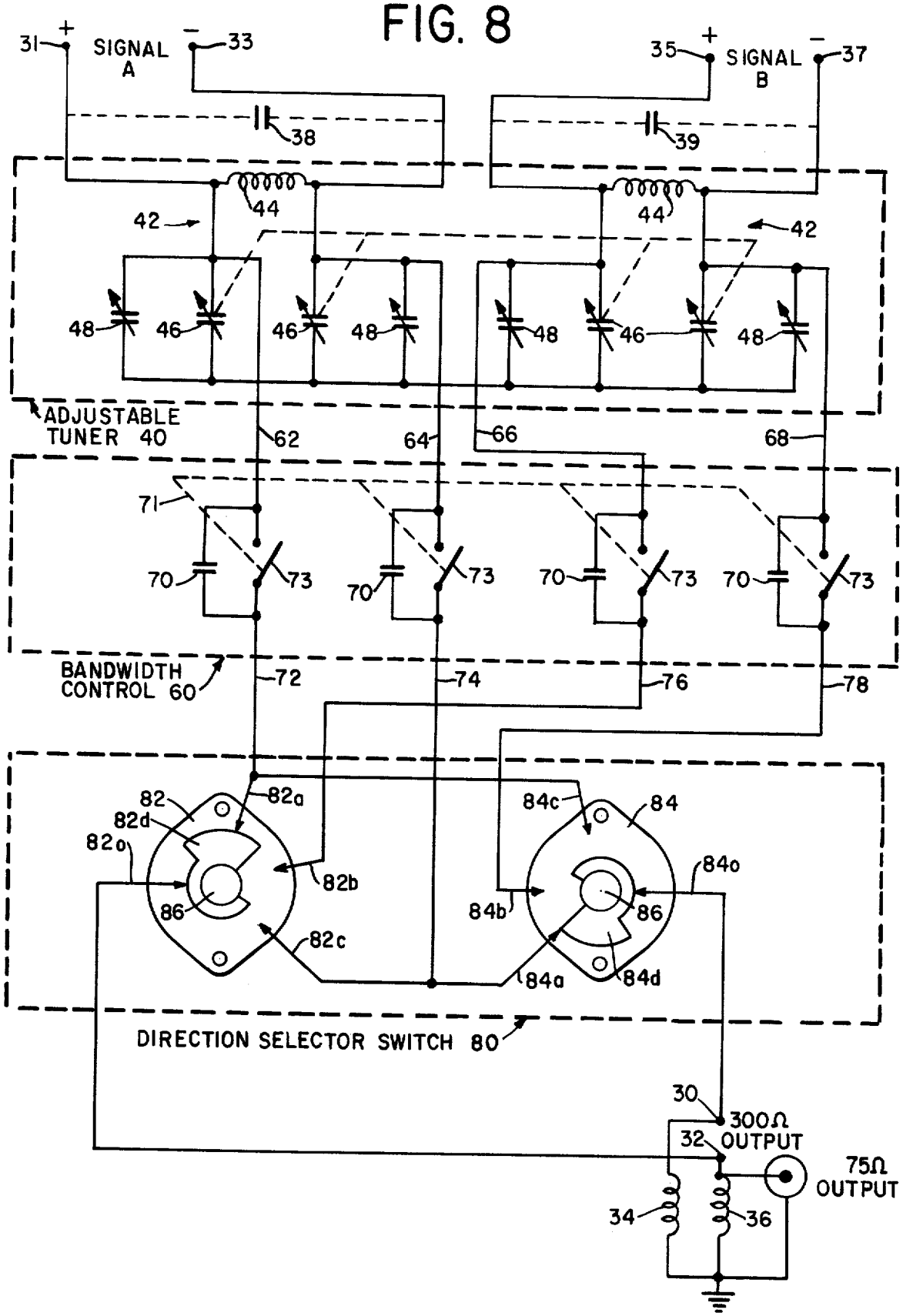
FIG. 8 is an electrical schematic diagram showing the circuit details of the antenna system of FIG. 1.

FIG. 8 is a schematic diagram illustrating the interconnection of the electrical components of the antenna system 10. Broadly, these electrical components comprise an adjustable tuner 40, which resonates the dipole components 20 at a frequency corresponding to a station to be received; a bandwidth control 60 which is operable to selectively adjust the bandwith of the antenna system 10 to be either narrow or wide; and a direction selector switch 80, which is operable to selectively combine the signals A and B from the dipole components 20 so as to produce an output signal between the terminals 30 and 32. By operating the switch 80, this output signal can be selected to be any of the following signal combinations: either of the dipole signals, the sum of the dipole signals, or the difference between the dipole signals. In this manner, the directionality of the antenna system can be selected. Terminals 30 and 32 are coupled to ground through balun transformers 34 and 36, respectively. This permits the output impedance between terminals 30 and 32 to be matched to the conventional receiver input impedance of 300 ohms, while balun 36 provides an output signal at an output impedance of 75 ohms (to match coaxial cable).

The signal A which is applied between input terminals 31 and 33 of adjustable tuner 40 appears between the innermost ends of the arms corresponding to one of the dipole components 20, and the signal B which is applied to the input terminals 35 and 37 of adjustable tuner 40 appears between the innermost ends of the arms corresponding to the other dipole component. The capacitances 38 and 39, which are shown in phantom, result from the capacitive top loading between the arms of each dipole component. Tuner 40 includes identical resonant circuits 42, each dedicated to one of the dipole components. Each of the resonant circuits 42 includes an inductor 44 across which the signal from the corresponding dipole component is applied. The ends of the inductor 44 are coupled to ground through identical variable capacitors 46, each of which is shunted by a variable trimmer capacitor 48. The capacitors 46 cooperate with the corresponding inductor 44 to define a sharply resonant circuit which is tunable to any desired frequency over the FM band. The capacitors 46 are all ganged so that they all assume the same value and are varied simultaneously. However, the trimmer capacitors 48 are provided to adjust for small discrepencies between different ones of the capacitors 46, thereby assuring that the capacitors 46 are all closely matched in value. In the preferred embodiment, the capacitors 46 are segments of a variable air capacitor 50 which are axially spaced along a common shaft. The trimmer capacitors 48 and the inductors 44 are mounted directly on the frame of the variable air capacitor 50.

The signals appearing at terminals 31, 33, 35 and 37 are coupled to bandwidth control 60 via leads 62, 64, 66 and 68, respectively. In bandwidth control 60, each of these signals passes through an identical series capacitor 70 and is provided to a corresponding one of the leads 72, 74, 76 and 78. Bandwidth control 60 also includes a four-pole-single-throw switch 71 in which each of the poles 73 is connected across one of the capacitors 70. With switch 71 open the signals from each of the dipole arms, which are applied, respectively, to terminals 31, 33, 35 and 37, pass through one of the capacitors 70 before being applied to direction selector switch 80. The capacitors 70 are designed precisely to impedance match the resonated dipole components to the 300 ohm input impedance of a conventional FM receiver. When such precise, lossless matching is provided for the resonated dipole components, their narrowband frequence responses are maintained and, in effect, a stage of sharply peaked bandpass filtering is added to the bandpass filtering of the receiver. This improves the selectivity of any receiver with which the antenna system is employed.

When switch 71 is closed, there is a short circuit across each of the capacitors 70, which produces an impedance mismatch between the resonated dipole components and the receiver input. This causes the bandwidth of the antenna system to be broadened so that the gain is substantially the same at every frequency within the FM band when tuner 40 is tuned to the center of the band. As will be explained in more detail below, this simplifies receiver tuning and the operation of the direction selector switch 80. In the preferred embodiment, each of the capacitors 70 is mounted directly between the terminals corresponding to one pole of the four-pole single-throw switch 71.

Direction selector switch 80 is a four-position rotary switch having a front deck 82 and a rear deck 84 axially spaced along a common shaft 86. Each deck of switch 80 has a single output contact, designated by the suffix o (i.e., contacts **82*o* and 84*o*), a plurality of input contacts designated by the suffixes a, b and c, and a rotating conductive element designated by the suffix d. Each of the rotating elements 82*d*, 84*d* is secured to the shaft 86 and moves with that shaft when the shaft is rotated. As the shaft 86 is rotated, elements 82*d* and 84*d* establish electrical connections between the output contacts 82*o*, 84*o*** and various of the corresponding input contacts.

In the preferred embodiment, the rotating elements **82*d*, 84*d* are constructed and arrnged as shown in FIG. 8. The position of the elements shown in this figure correspond to position 1 of selector switch 80. Position 2 of the selector switch is separated from position 1** by 45° of clockwise rotation and each successive position of the switch is separated from the previous position by an additional 45° of clockwise rotation.

Table I lists the signals that are connected to terminals 30 and 32 in each of the positions of switch 80.

TABLE I

| | Terminal 32 | Terminal 30 |
|---|---|---|
| POS. 1 | $A^+$ | $A^-$ |
| POS. 2 | $A^+ + B^+$ | $A^- + B^-$ |
| POS. 3 | $B^+$ | $B^-$ |
| POS. 4 | $A^- + B^+$ | $A^+ + B^-$ |

The plus and minus signs in the upper right-hand corner of the letters A and B indicate which side of the corresponding signal is applied to the indicated terminal. In position 1, terminal 32 receives the positive side of signal A and terminal 30 receives the negative side of signal A, so that signal A appears between the output terminals 30,32. In position 2, terminal 32 receives the positive sides of signals A and B and terminal 30 receives the negative sides of signals A and B, so that the sum of the two signals appears between the output terminals. Similarly, signal B appears between the output terminals when switch 80 is in position 3 and the difference between the signals B and A appears between the output terminals when the switch is in position four.

Inasmuch as the signals A and B are obtained from dipole components which are arranged to receive signals from mutually perpendicular directions, it will be appreciated that each of the four signals produced between the terminals 30 and 32 corresponds to reception from a different direction.

In operation, the antenna system 10 and the receiver to which it is connected are quickly and easily tuned for optimum reception by a two-step procedure. During the initial step, adjustable tuner 40 is set approximately to the middle of the FM band and switch 71 is closed. As a result, antenna system 10 provides substantially the same gain at each frequency in the FM band. The FM receiver and direction selector switch 80 can then be adjusted independently for the best reception. For the second step, tuner 40 is adjusted to the approximate frequency of the station to be received and switch 71 is opened. This places antenna system 10 in its narrowband mode. Tuner 40 can then be further adjusted for overall optimum reception.

Although specific embodiments of the invention have been disclosed for illustrative purposes, it will be appreciated by the those skilled in the art that many additions, modifications and substitutions are possible without departing from the scope and spirit of the invention as defined in the accompanying claims.

What is claimed is:

1. An elongated arm for use in a high frequency, directable antenna system for use with a receiver operating over a predefined reception band, said system having: a plurality of crossed dipole antenna components of substantially shorter length than a half wavelength of any frequency to be received, each of said dipole components being positioned to receive a signal from a different predetermined direction, each of said dipole components including a first and second of said elongated arms arranged in longitudinal alignment; selector means coupled to each of said dipole components and operable to produce a composite signal combining selected ones of the signals received by said dipole components; said elongated arm comprising a portion in the form of a conductive channel member with a generally U-shaped cross-section, said channel member including substantially parallel sides and a bottom, said bottom being removed over a section of said channel member near one end thereof, the parallel sides of said section being folded toward the opposite end of said arm to form a generally wedgeshaped, flared front for said arm.

2. An elongated arm for use in a high frequency, directable antenna system for use with a receiver operating over a predefined reception band, said system having: a plurality of crossed dipole antenna components of substantially shorter length than a half wavelength of any frequency to be received, each of said dipole components being positioned to receive a signal from a different predetermined direction, each of said dipole components including a first and second of said elongated arms arranged in longitudinal alignment; selector means coupled to each of said dipole components and operable to produce a composite signal combining selected ones of the signals received by said dipole components; said elongated arm comprising a portion in the form of a conductive channel member with a generally U-shaped cross-section, said arm having a flared front being formed from a piece of conductive sheet material which is formed into a wedge shape and secured at one end of said channel member with the angle of the wedge shape opening towards the other end of said channel member.

3. An elongated arm for use in a high frequency, directable antenna system for use with a receiver operating over a predefined reception band, said system having: a plurality of crossed dipole antenna components of substantially shorter length than a half wavelength of any frequency to be received, each of said dipole components being positioned to receive a signal from a different predetermined direction, each of said dipole components including a first and second of said elongated arms arranged in longitudinal alignment; selector means coupled to each of said dipole components and operable to produce a composite signal combining selected ones of the signals received by said dipole components; said elongated arm comprising a single strip of conductive material including an outer portion contiguous with either end of said strip and an inner portion intermediate said outer portions, said inner portion being longitudinally formed into a generally diamond-shaped flared front.

said outer portions being arranged to extend away from said flared front in opposed relationship.

4. A high frequency, directable antenna system for use with a receiver that is tunable to receive any of a plurality of stations each occupying a different assigned frequency band, said system comprising:

a plurality of crossed dipole antenna components of substantially shorter length than a half wavelength of the highest frequency to be received, each of said dipole components being positioned to receive a signal from a different predetermined direction, each of said dipole components comprising first and second elongated arms arranged in longitudinal alignment, each of said arms having a flared front at the end most remote from the other arm, said flared front including a portion which extends rearwardly and substantially outwardly of said arm so that said arms are shaped generally like an arrow head at their fronts; and tuner circuit means coupled to each of said dipole components for resonating said dipole components at a predetermined frequency in a selectable assigned frequency band;

circuit means for controlling the reception bandwidth of the resonated dipole components; and selector means responsive to the signal from each of said dipole components for producing a composite signal combining selected ones of said dipole component signals, the selection of a particular composite signal making said antenna system responsive to signals from a predefined corresponding direction.

5. An antenna system according to claim 4 said bandwidth control means comprises:

network means which substantially losslessly impedance matches said resonated dipole components to the input of said receiver; and adjustable means actuable to cooperate with said network means to produce an impedance mismatch between said resonated dipole components and said receiver input so that the bandwidth of said resonated dipole components is substantially widened.

6. A method for providing optimum reception of a selected station in a receiver connected to receive the composite signal from an antenna system in accordance with claim 4 said method comprising the steps of:

operating said bandwidth control means to substantially broaden the bandwidth of said resonated dipole components;

adjusting said receiver to receive the selected station;

operating said selector means to produce the strongest composite signals;

operating said bandwidth control means to substantially narrow the bandwidth of said resonated dipole components; and operating said tuner means to maximize said composite signal.

7. An electrically directable integrated antenna and tuning system for use with a receiver which is tunable to individual stations each occupying a different predetermined assigned frequency band, comprising:

a plurality of end loaded, crossed dipole antenna components arranged so that each receives signals from a different predetermined direction;

tuner circuit means coupled to each of said dipole components for resonating said dipole components at a predetermined frequency in a selectable assigned frequency band;

circuit means independently operable for controlling the reception bandwidth of the resonated dipole components; and selector means responsive to the signal from each of said dipole components for producing a composite signal combining selected ones of said dipole component signals, the selection of a particular composite signal making said antenna system responsive to signals from a predefined corresponding direction.

8. An antenna system according to claim 7 wherein said bandwidth control means comprises:

network means which substantially losslessly impedance matches said resonated dipole components to the input of said receiver; and adjustable means actuable to cooperate with said network means to produce an impedance mismatch between said resonated dipole components and said receiver input so that the bandwidth of said resonated dipole components is substantially widened.

9. A method for providing optimum reception of a selected station in a receiver connected to receive the composite signal from an antenna system in accordance with claim 7, said method comprising the steps of:

operating said bandwidth control means to substantially broaden the bandwidth of said resonated dipole components;

adjusting said receiver to receive the selected station;

operating said selector means to produce the strongest composite signals;

operating said bandwidth control means to substantially narrow the bandwidth of said resonated dipole components; and operating said tuner means to maximize said composite signal.

* * * * *